US005372073A

United States Patent [19]

Cattani

[11] Patent Number: 5,372,073

[45] Date of Patent: Dec. 13, 1994

[54] TRUCK FOR LOW-PLATFORM CARS

[75] Inventor: Ildebrando Cattani, Muttenz, Switzerland

[73] Assignee: Schindler Waggon AG, Pratteln, Switzerland

[21] Appl. No.: 127,088

[22] Filed: Sep. 27, 1993

Related U.S. Application Data

[63] Continuation of Ser. No. 675,905, May 21, 1991, abandoned.

[30] Foreign Application Priority Data

Aug. 21, 1989 [CH] Switzerland ..... 3043/89-2

[51] Int. Cl.[5] ..... B61F 5/00

[52] U.S. Cl. ..... 105/3; 105/133; 105/165; 105/175.1; 105/158.2; 105/199.1

[58] Field of Search ..... 105/1.4, 3, 4.3, 4.4, 105/8.1, 25.2, 133, 172, 175.1, 158.2, 165, 168, 135, 132.1, 96, 169, 199.1

[56] References Cited

U.S. PATENT DOCUMENTS

| | | | |
|---|---|---|---|
| 39,332 | 7/1863 | Arnoux | 105/165 |
| 1,412,383 | 4/1992 | Barrow | 105/165 |
| 1,880,953 | 10/1932 | Fageol | 105/133 |
| 2,843,417 | 7/1985 | Wahl et al. | 105/3 |
| 2,977,897 | 4/1961 | Lich | 105/3 |
| 4,697,526 | 10/1987 | Vigliani | 105/3 |
| 4,781,123 | 11/1988 | Yoshihara | 105/3 |
| 4,823,706 | 4/1989 | McSweeney | 105/165 |
| 5,024,166 | 6/1991 | Ahlborn et al. | 105/453 |

FOREIGN PATENT DOCUMENTS

| | | | |
|---|---|---|---|
| 0215673 | 3/1987 | European Pat. Off. | 105/3 |
| 0686768 | 7/1930 | France | 105/3 |
| 8418197 | 5/1986 | France . | |
| 8505602 | 12/1985 | WIPO | 105/3 |
| 8705873 | 10/1987 | WIPO | 105/133 |

*Primary Examiner*—Mark T. Le

*Attorney, Agent, or Firm*—Ostrolenk, Faber, Gerb & Soffen

[57] ABSTRACT

In the truck (1) the static and dynamic forces are absorbed by the frame (5). In designing the body unit fitted on the frame (5), therefore, only the unit's own weight and the passenger load are significant, thus facilitating the use of extremely lightly-built vehicle bodies. The truck (1) has single-wheel drive units (2), a longitudinal driver (3) interconnecting them, on each long side of a drive (4), the frames (5) bearing the end unit (9) and a drive control (6) for turning the single-wheel drive units (2) horizontally in response to curves. A wheelless central unit (10) is supported on each short side of the truck (1) via a link (8). A push-pull device (7) engages with the short side opposite the link (8). There are no steps, pedestals or shoulders inside the vehicle which is thus freely accessible. In the region of the truck there are recesses in the form of wheel-boxes (9.1) in which certain parts of the truck (1) are arranged.

12 Claims, 11 Drawing Sheets

TRUCK FOR LOW-PLATFORM CARS

This is a continuation of application Ser. No. 07/675,905, filed on May 21, 1991, now abandoned.

BACKGROUND OF THE INVENTION

The present invention relates to a truck for low-platform cars.

A device of background interest is disclosed in French Unexamined Application 2 573 715 on which car bodies with lowered floors can rest. Each wheel is provided with its own axle. The axles of each of the front and rear sets of wheels are connected by a rigid axle lying below the wheel center point. A truck frame consisting of longitudinal and transverse members lies on the axles on the inner side of the wheels. In the center of the longitudinal member a secondary springing means is provided for supporting the two car bodies.

The disadvantage of this known arrangement is that, despite cranked wheel-set axles, pedestals are unavoidable within the car. The axles on the wheel inner side and the truck frame supported thereon reduce the lowered floor surface and require cut outs in the form of pedestals and shoulders within the car. Furthermore, the rigid arrangement of the cranked wheel set axles no longer satisfy the demands made on modern trucks.

SUMMARY OF THE INVENTION

The invention is directed at remedying above-mentioned problems. A low-platform truck with a truck frame is configured such that the low-platform car body is supported by the truck frame and that the difficulties which arise due to travel over curved sections are nevertheless avoided.

The advantages obtained by the present invention reside essentially in the fact that a stepless low-platform car body provided with a continuous floor and being of extremely light construction can be used and that, despite the truck frame which bears the car body, travel around curves can be effected silently and without wear. Furthermore, the truck is completely preassembled, and thus, the car bodies need merely to be placed on the truck frame and attached to it.

BRIEF DESCRIPTION OF THE DRAWINGS

The invention will be described below with reference to the drawings, which shows merely one embodiment. In the drawings.

DESCRIPTION OF A PREFERRED EMBODIMENT

Figure 1:
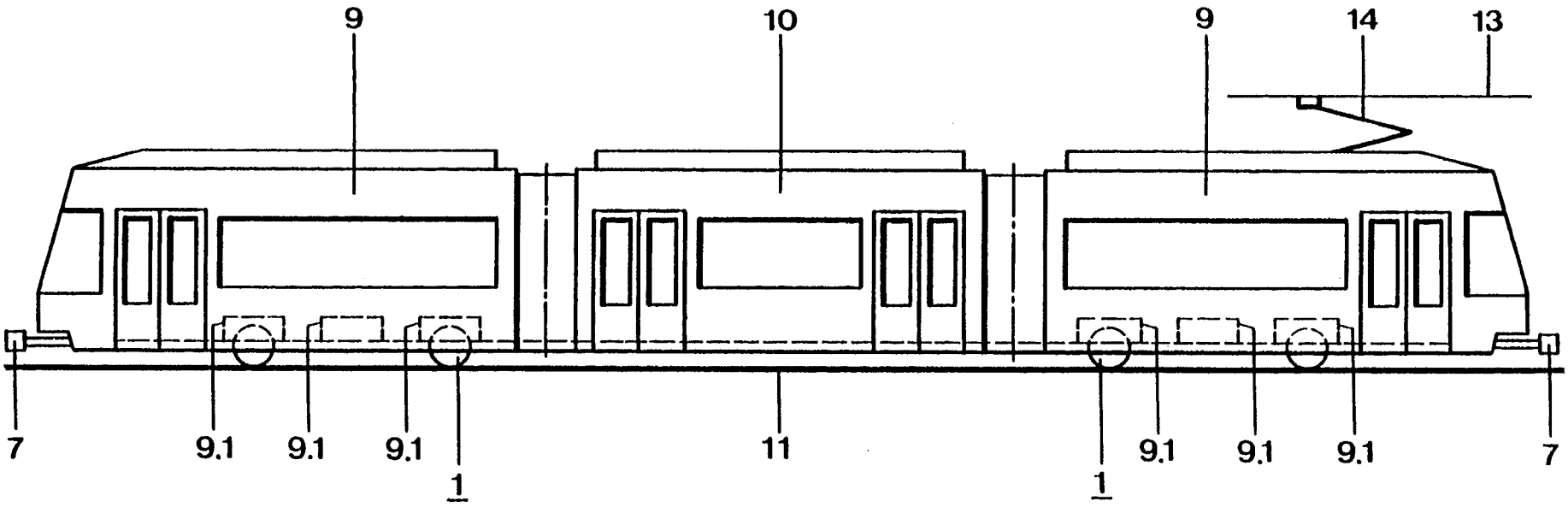
FIG. 1 is an outside view of a three-part low-platform car with trucks in accordance with the invention.
Figure 2:
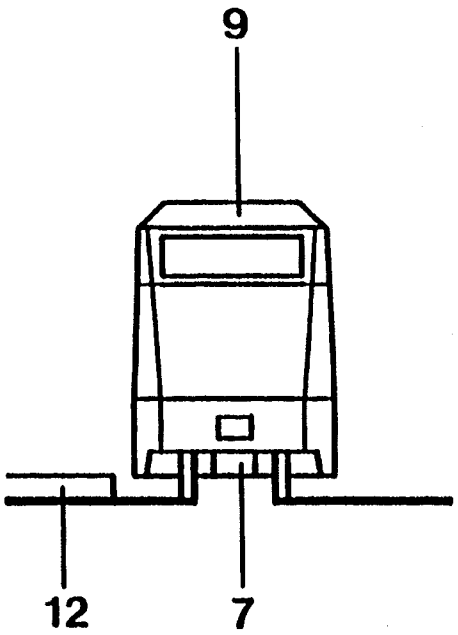
FIG. 2 is a diagrammatic cross-sectional view of the low-platform truck of FIG. 1.
Figure 3:
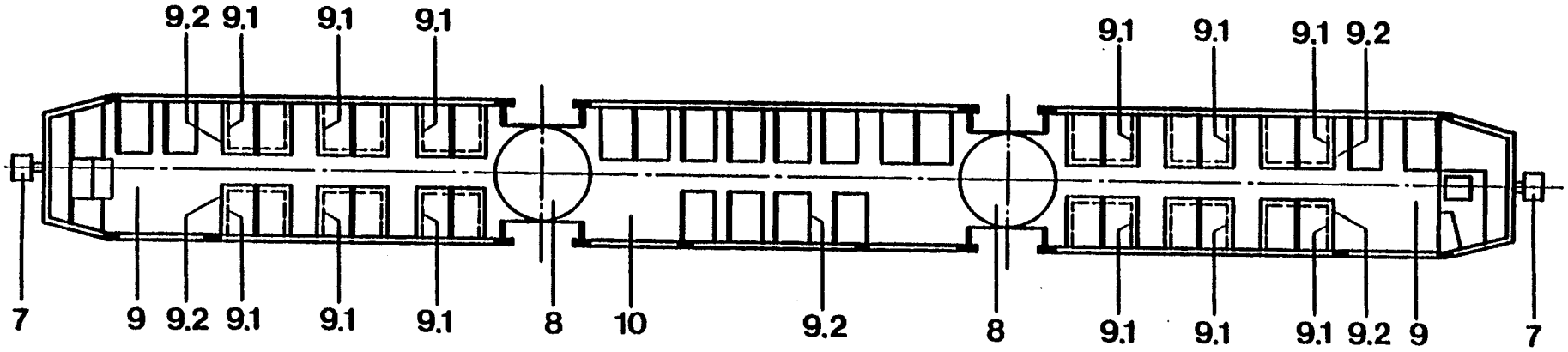
FIG. 3 is a horizontal longitudinal section through the low-platform truck of FIG. 1.

FIGS. 1 to 10 show a low-platform car consisting of two end bodies 9 and a middle body 10. See FIGS. 1–3. The end bodies 9 are each supported by a truck 1. The wheel-less middle body 10 is supported on each narrow side via a link 8 on the truck 1. The low-platform car is adapted for travel on rails 11. The inside of the car has no pedestals and can be reached without the use of a step from a footpath 12 (FIG. 2). In the region of the truck, the recesses in the form of wheel boxes 9.1 are provided below the seats 9.2, given parts of the truck 1 being arranged in the wheel boxes. The low-platform car is supplied with electric power from a trolley wire 13 via a current pick-up 14.

Figure 4:
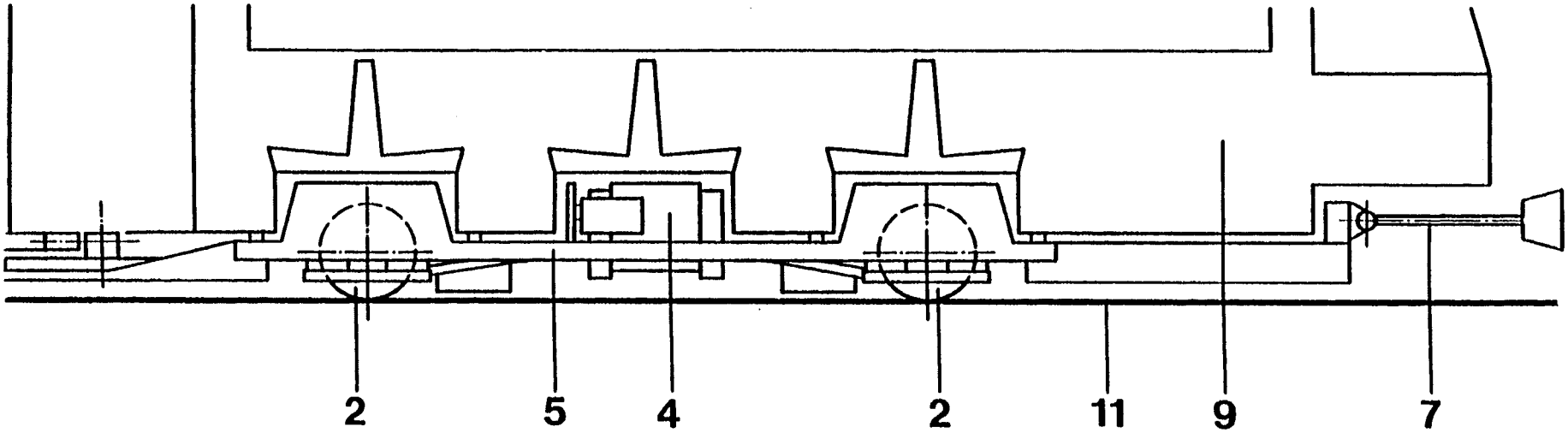
FIG. 4 is a view in elevation of a truck according to the invention.
Figure 5:
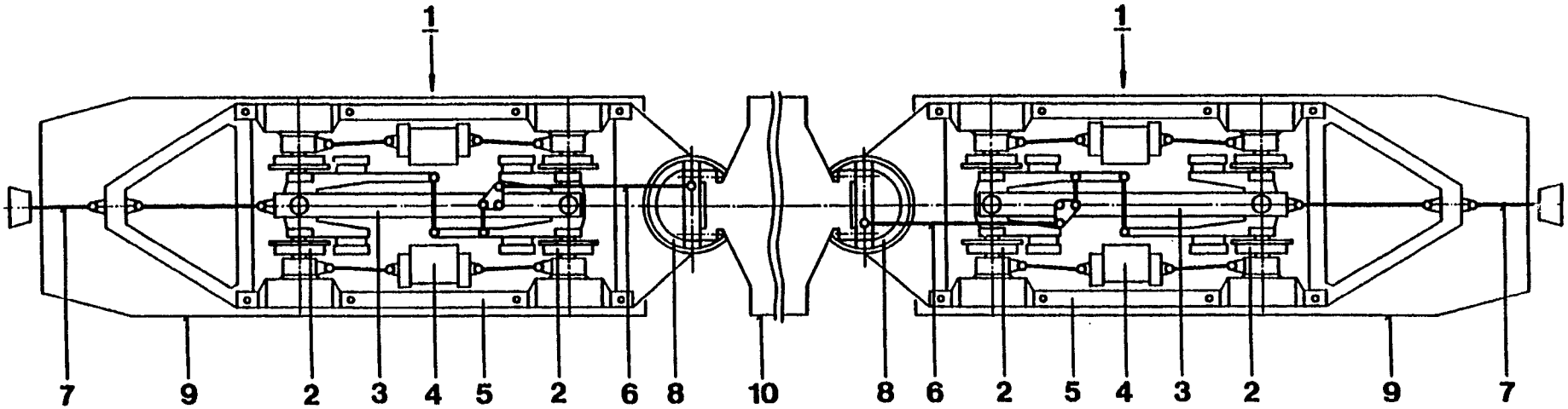
FIG. 5 shows the truck of the invention in a horizontal projection of the low platform car of FIG. 1.

Referring now to FIGS. 4 and 5, the truck 1 includes positively controlled single-wheel individual running gears 2, a longitudinal driver 3 connecting the single-wheel individual running gears 2, and on each wide lateral side, a drive 4, a truck frame 5, and a running gear control 6. On the narrow side opposite the link 8 a push-pull device 7 acts.

Figure 7:
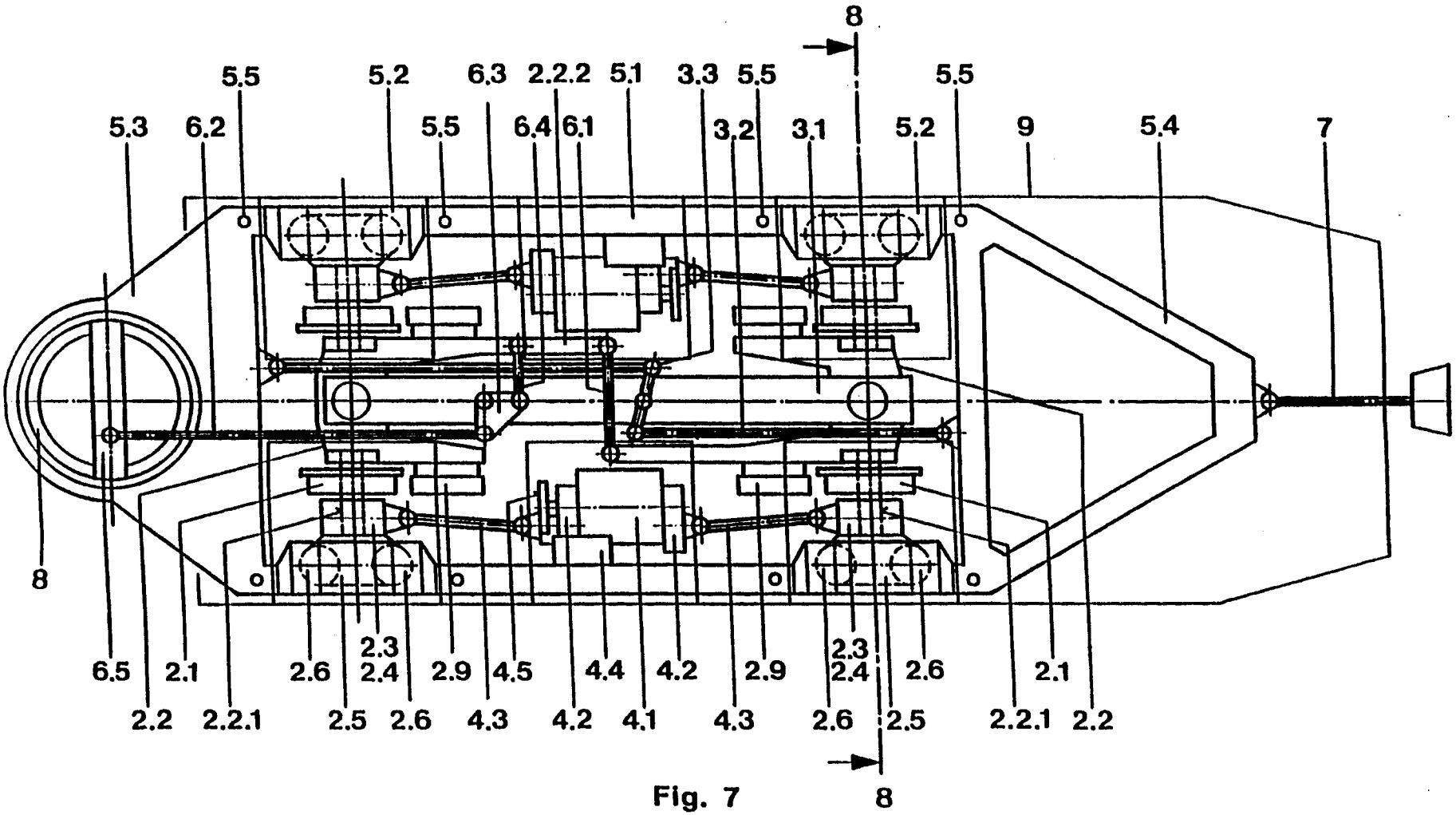
FIG. 7 is a horizontal projection of truck of the invention shown in FIG. 5.
Figure 8:
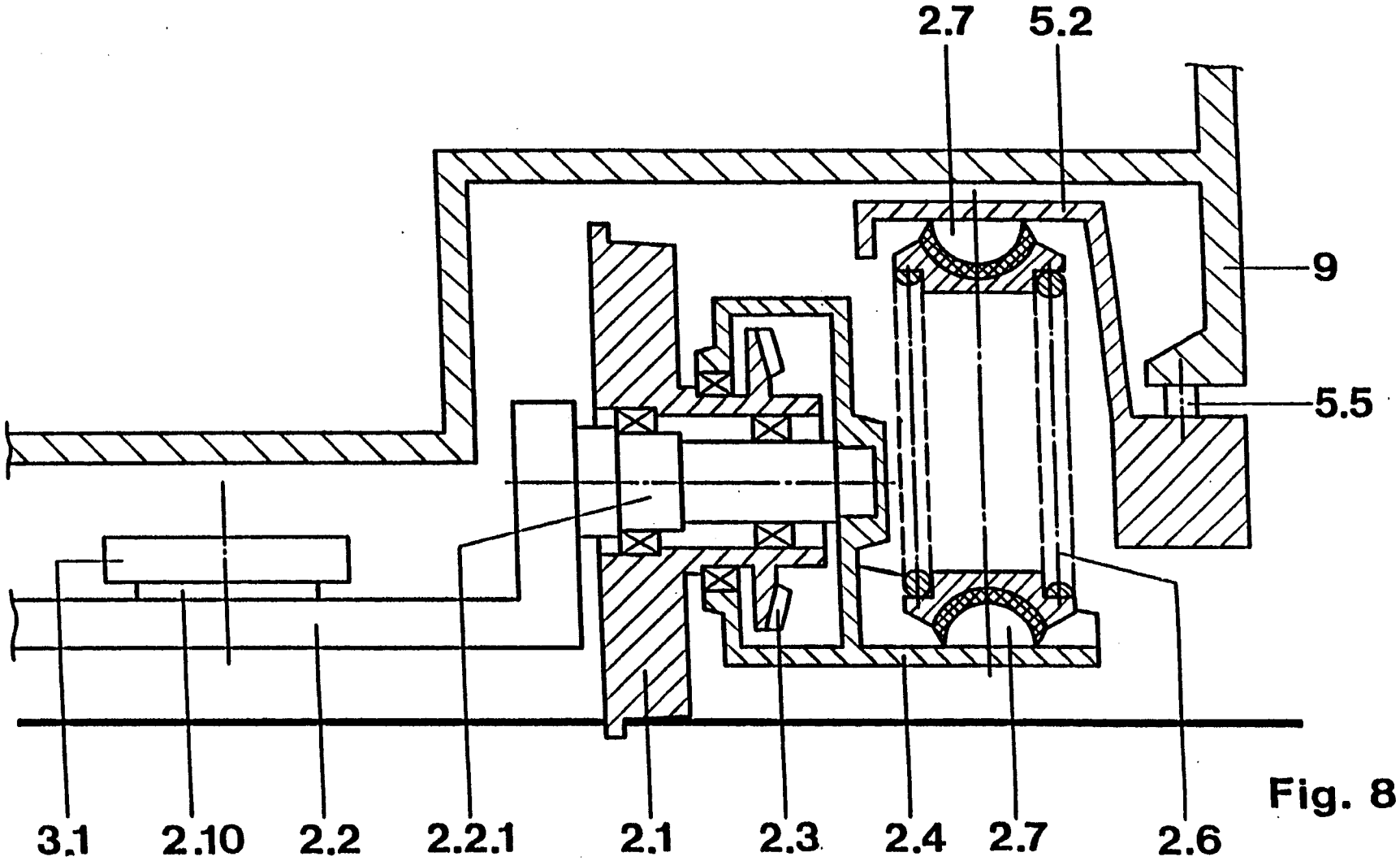
FIG. 8 is a section along the line AA of FIG. 7 through a single-wheel individual running gear with body springs supported on the transmission housing.
Figure 9:
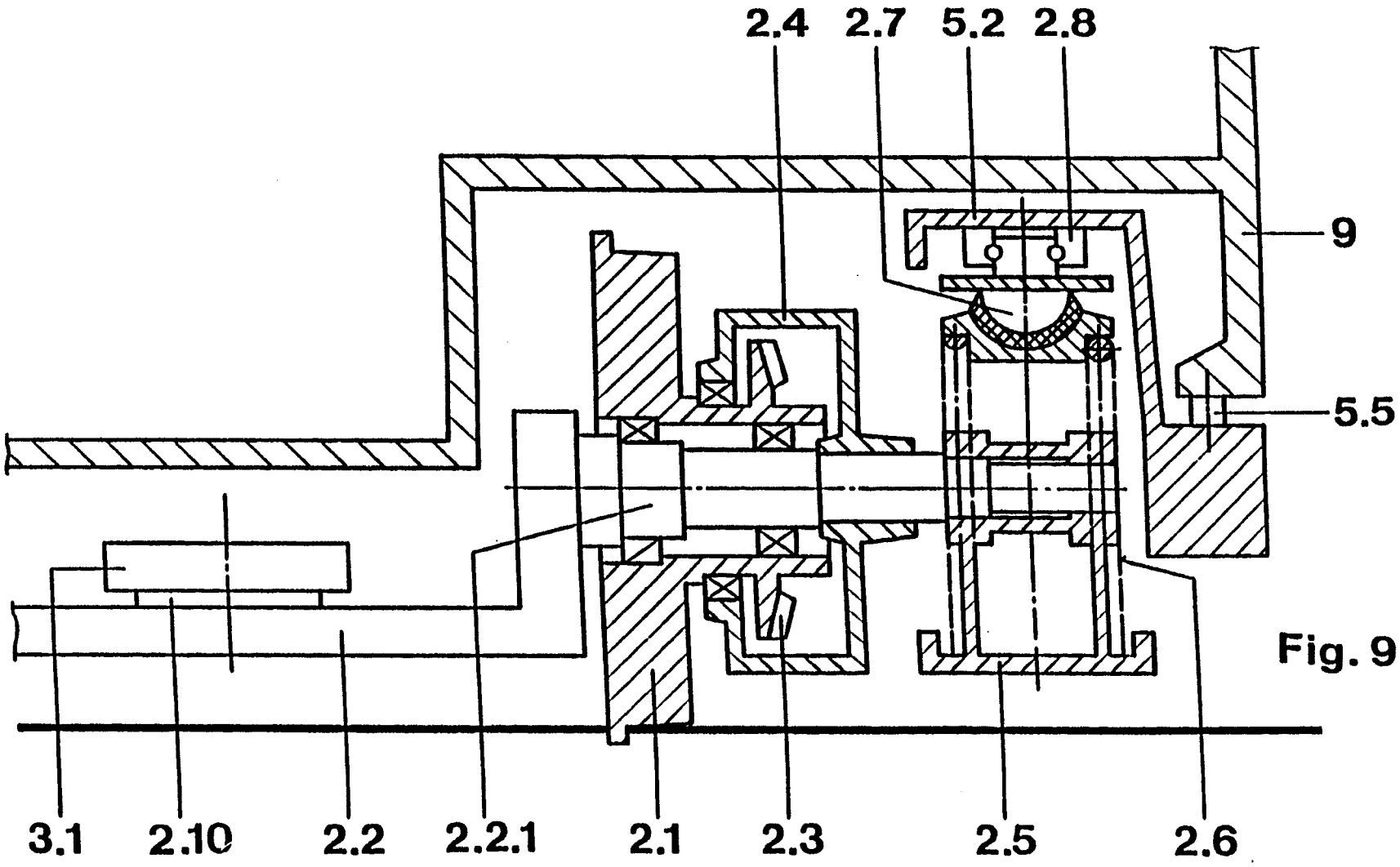
FIG. 9 is a section along the line A—A of FIG. 7 through a single-wheel individual running gear having a spring carrier mounted on a stub axle.
Figure 10:
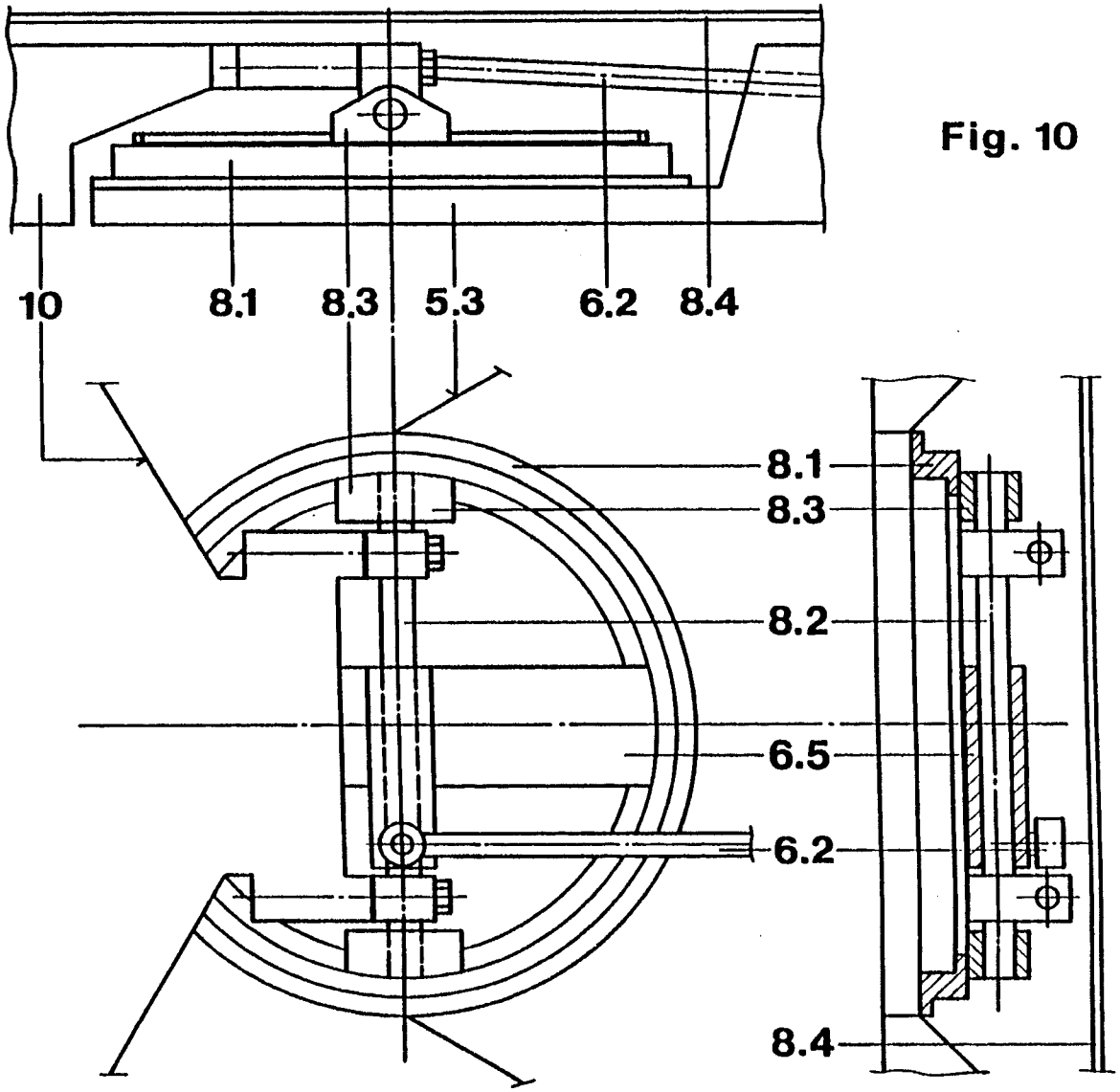
FIG. 10 is a section through a link connecting the end and middle cars.

Please refer now to FIGS. 6–9. A truck frame 5 is supported via four frame integrated spring pots 5.2 and the body springs 2.6 which are in turn supported by gear housing 2.4 (FIG. 8) or spring supports 2.5 (FIG. 9). A single-wheel individual running gear 2 has two single wheels 2.1 with stub axles 2.2.1 which are connected by a cranked wheel bridge 2.2 lying on the narrow side. On the outside of the wheel, wheel gears 2.3 and body springs 2.6 are provided.

In a first embodiment shown in FIG. 8, the body springs 2.6 rest via elastic spring supports 2.7 on gear housings 2.4. The elastic spring supports 2.7 permit horizontal turning as a function of the curves, of the single-wheel individual running gears 2. In an alternate embodiment shown in FIG. 9, a spring support separate from the gear housings 2.4 is provided. The body springs 2.6 rest on spring supports 2.5 which are mounted on the stub axles 2.2.1. Ball turning rim segments 2.8 permit horizontal turning of the single-wheel individual running gears 2 as a function of the curve. In both embodiments, the body springs 2.6 which are developed as flexicoil springs and the resilient spring supports 2.7 dampen the rocking movements of the car bodies.

Figure 6:
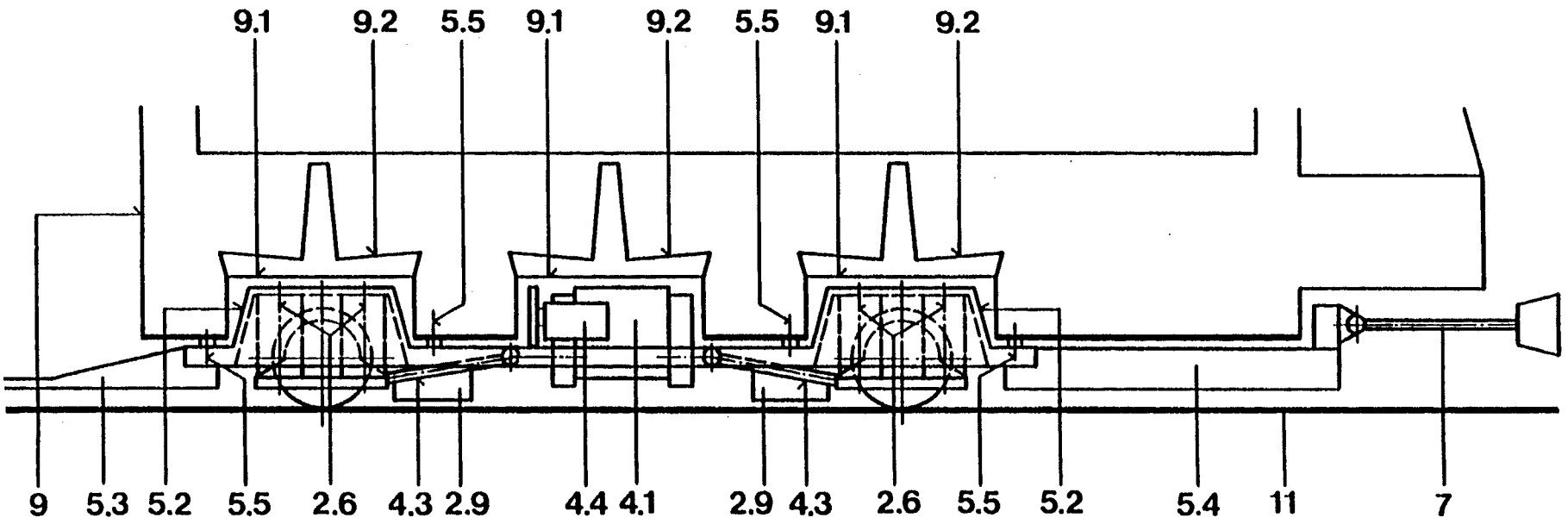
FIG. 6 is an elevation of the truck of the invention shown in FIG. 4.

Referring now to FIGS. 6 and 7, the wheel bridge 2.2 is articulated centrally by means of a pivot pin to a driver support 3.1 which, via driver rods 3.2 and a driver equalization lever 3.3, transmits traction and braking forces to the truck frame 5. On each wide side there are arranged on the truck frame 5 a drive motor 4.1 with spur gearing 4.2 and brake disk 4.5 as well as a spring-accumulator braking unit 4.4. The drive motor 4.1 drives the individual wheels 2.1 via universal shafts 4.3. In an alternate embodiment, trucks 1 without drive 4 are provided. 2.9 is an electromagnetic rail brake.

Figure 11:
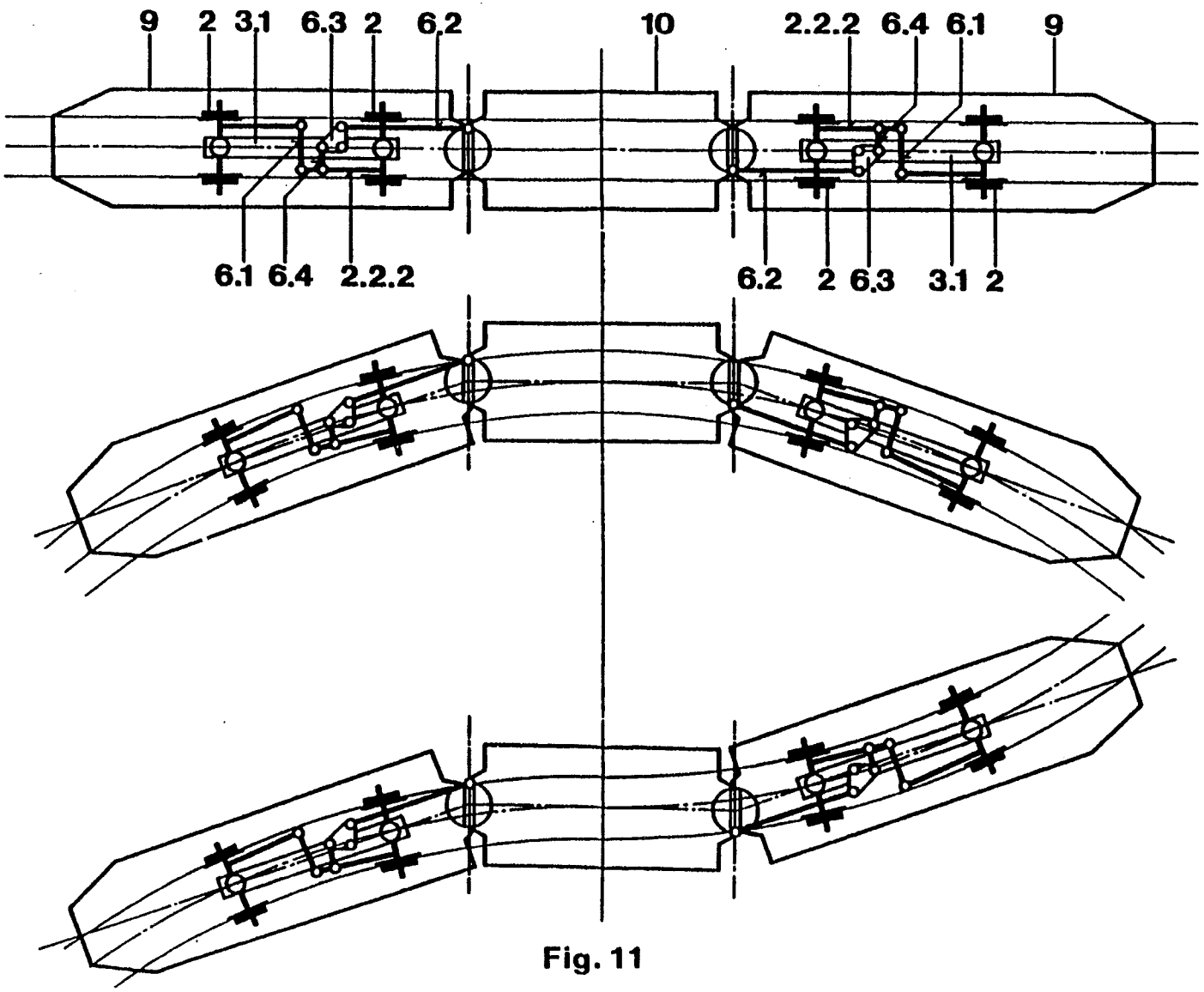
FIG. 11 is a schematic drawing showing the operation of the invention on three types of curves.

The truck frame 5 includes longitudinal members 5.1 with spring pots 5.2 to take up the forces produced by the end and middle bodies 9, 10, the forces produced by an articulation support 5.3 disposed on the narrow side of the frame for supporting the wheel-less middle body 10 and taking up the forces produced by it, as well as of a coupling support 5.4, which lies opposite the articulation support 5.3 and on which the pull-push device 7 acts. The single-wheel individual running gears 2 are provided on the wheel bridges 2.2 with steering levers 2.2.2 which are connected by means of a truck steering rod 6.1. Referring to FIG. 11, to allow for horizontal turning or steering as a function of curves, the angle of articulation between middle body 10 and end bodies 9 is transmitted via a control lever 6.5 (FIG. 7), a steering rod 6.2, a deflection angle lever 6.3 arranged turnably on the driver support 3.1 and a control rod 6.4 to the steering lever 2.2.2 of the single-wheel individual running gear lying closer to the middle body 10. When end body 9 travels through a curve, steering rod 6.2 pivots lever 6.3 causing control rod 6.4 to move steering lever 2.2.2 and steer wheel 2 through the curve.

After the complete preassembly of truck 1, the end body 9 is placed on the truck frame 5 and fastened to it by means of fastening elements 5.5. The middle body 10 is mounted with the link 8. End bodies 9 and middle body 10 are pivotly connected to each other by means of the link 8. A central ring of a tripartite ball turning rim 8.1 (FIG. 10) is firmly connected to the articulation support 5.3 of the truck frame 5. An articulation shaft 8.2 lying transverse to the direction of travel is held in resilient mounts 8.3 which are arranged on a ring of the ball turning rim 8.1. A horizontally turnable rotary platform 8.4 is firmly connected to an outer ring of the ball turning rim 8.1. The link 8 which operates in the manner of a universal joint permits the end and middle bodies 9, 10 to carry out not only rocking movements but also rotating movements in the horizontal and vertical planes. From middle body 10, forces are transferred to articulation support 5.3 via articulation shaft 8.2, resilient mounts 8.3 and tripartite ball turning rim 8.1. Ball turning rim 8.1 allows for horizontal turning movement between middle body 10 and end bodies 9. Articulation shaft 8.2 allows for vertical movement in the event of a sudden change in the slope of rails 11.

I claim:

1. A truck for low-platform cars, comprising:

a plurality of cranked wheel bridges;

a pair of wheels, each wheel having a top portion, said pair of wheels being arranged on each said wheel bridge to be rotatable about an axis of rotation, and separated from each other thereby defining a space therebetween, said wheels being structured and arranged to be driven for said rotation from an outer side of each said wheel;

a frame having a wide side and a narrow side adapted to support a low-platform car body, said frame comprising means for coupling said frame to at least one frame of a next low-platform car; and means for supporting said frame with respect to said wheel bridges;

wherein said wheel bridges are pivotally connected to a driver support extending generally parallel to said wide side of said frame enabling relative pivoting of said wheel bridges, said driver support being located at a level below said axis of rotation of said pair of wheels such that a floor of said low-platform car body extends into the space between said pair of wheels, whereby said floor is at a level below the top portions of said pair of wheels.

2. A truck according to claim 1, wherein said means for supporting said frame comprises body springs disposed on said wheel bridges and spring pots disposed on said frame to dampen rocking movements of said frame during transport.

3. A truck according to claim 1, further comprising:

means interconnecting the driver support and each wheel bridge for enabling said wheel bridges to rotate with respect to said driver support in response to curved rail sections; and said means for supporting said frame comprises:

body springs disposed on said wheel bridges, said body springs dampening rocking movements of said frame during transport; and spring pots disposed on said frame and extending to a height above said body springs, said spring pots taking up forces produced in said frame during transport.

4. A truck according to claim 3, wherein said means for supporting said frame further comprises:

elastic spring supports disposed between said body springs and said spring pots, said elastic spring supports facilitating rotation of said wheel bridges with respect to said driver support.

5. A truck according to claim 3, wherein the body springs are flexicoil springs.

6. A truck according to claim 4, wherein said means for supporting said frame further comprises:

a bearing means disposed between said spring pots and said elastic spring supports, said bearing means facilitating rotation of said wheel bridges with respect to said driver support.

7. A truck according to claim 1, wherein said frame further comprises:

longitudinal members disposed on said wide side having means for dampening rocking movements of said frame during transport; and wherein said means for coupling said frame to at least one frame of a next low-platform car comprises a drawbar disposed on said narrow side.

8. A truck according to claim 1, further comprising a wheel drive disposed between said wheel bridges on said wide side for driving said wheels.

9. A truck according to claim 8, wherein said wheel drive comprises a drive motor, said drive motor acting on wheel gears through universal shafts to drive said wheels.

10. A truck according to claim 1, further comprising steering means for controlling said wheel bridges, said steering means comprising:

a control lever transmitting an angle of articulation between coupled truck frames to a steering rod;

a steering lever connected to each of said wheel bridges on opposing sides thereof, said steering levers extending along said wide side to a midpoint of said frame;

a truck steering rod extending along said narrow side between said steering levers, said truck steering rod transmitting movement of one of said steering levers to the other of said steering levers;

a control rod pivotally connected to one of said steering levers; and a deflection angle lever connecting said steering rod to said control rod, said deflection angle lever being arranged for rotation on the driver support to transmit movement of said steering rod to said control rod.

11. A truck according to claim 10, further comprising a bearing race disposed on said narrow side, said bearing race comprising:

an inner, central, and outer ring; and a universal shaft lying transverse to the direction of travel and held in elastic mounts, said steering rod being fixed to said universal shaft.

12. A truck according to claim 1, wherein said driver support comprises:

two driver rods, each of said driver rods connected at one end to the truck frame and at the other end to a driver equalization lever, said driver equalization lever connecting said driver support to said two driver rods.

* * * * *